US005697703A

United States Patent [19]

Lucchetti

[11] Patent Number: 5,697,703

[45] Date of Patent: Dec. 16, 1997

[54] RECIPROCAL DRIVE MECHANISM FOR AUTOMATIC PAINT STIRRING EQUIPMENT

[75] Inventor: David Lucchetti, Walled Lake, Mich.

[73] Assignee: Dedoes Industries, Inc., Walled Lake, Mich.

[21] Appl. No.: 774,045

[22] Filed: Dec. 27, 1996

[51] Int. Cl.[6] ..... B01F 11/00

[52] U.S. Cl. ..... 366/198; 366/278; 366/605

[58] Field of Search ..... 366/197, 198, 366/242–251, 605, 276–278; 68/12.24, 23.7, 132, 136

[56] References Cited

U.S. PATENT DOCUMENTS

| | | | |
|---|---|---|---|
| 321,031 | 6/1885 | Jackson | 366/243 X |
| 408,818 | 8/1889 | Stout | 366/243 |
| 409,533 | 8/1889 | Walter | 366/243 |
| 425,693 | 4/1890 | Patterson | 366/243 X |
| 627,968 | 7/1899 | Benbow | 366/276 X |
| 796,685 | 8/1905 | Waybright | 366/276 X |
| 957,248 | 5/1910 | Pettit | 366/243 |
| 2,428,492 | 10/1947 | Haller . | |
| 2,603,461 | 7/1952 | Marienthal . | |
| 2,757,910 | 8/1956 | O'Neill . | |
| 2,802,649 | 8/1957 | Stockton | 366/605 X |
| 2,965,363 | 12/1960 | Worden | 366/605 X |
| 3,118,653 | 1/1964 | Dedoes | 366/251 X |
| 5,160,198 | 11/1992 | Fillon | 366/605 X |
| 5,496,109 | 3/1996 | Dedoes | 366/605 X |

FOREIGN PATENT DOCUMENTS

| | | | |
|---|---|---|---|
| 2102417 | 4/1972 | France | 366/198 |
| 2203059 | 10/1988 | United Kingdom | 366/605 |

*Primary Examiner*—Charles E. Cooley

*Attorney, Agent, or Firm*—Gifford, Krass, Groh, Sprinkle, Patmore, Anderson & Citkowski, P.C.

[57] ABSTRACT

A drive mechanism for automatic paint stirring equipment of the type having a housing and a plurality of spaced apart and parallel shafts rotatably mounted to the housing. Each shaft is adapted for detachable driving connection with a stirring assembly associated with a lid on a paint can supported on the housing. The drive mechanism includes a gear wheel secured to an upper end of each of the shafts and an elongated rigid gear rack which meshingly engages a plurality of the gear wheels on the shafts. The gear rack is reciprocally longitudinally driven through a wheel and link assembly to simultaneously reciprocally drive the shafts in alternating rotational directions. This alternating rotational movement is, in turn, transferred to the stirring assembly associated with the paint can for each of the drive shafts.

6 Claims, 1 Drawing Sheet

RECIPROCAL DRIVE MECHANISM FOR AUTOMATIC PAINT STIRRING EQUIPMENT

BACKGROUND OF THE INVENTION

1. Field of the Invention

The present invention relates generally to automatic paint stirring equipment and, more particularly, to a novel drive mechanism for automatic paint stirring equipment.

2. Description of the Prior Art

There are many types of previously known automatic paint stirring equipment of the type used in automotive body repair shops. In general, the automatic paint stirring equipment comprises a housing having a plurality of shafts rotatably mounted to the housing about a generally vertical axis. Paint cans having a lid with a stirring assembly associated with the lid are then removably secured to and supported by the housing. Once the paint can with its lid is supported by the housing, a drive coupling between the lower end of the shaft and the stirring assembly for the paint can detachably engage each other so that rotation of the shaft is transmitted to the stirring assembly thus stirring the paint in the desired fashion.

In order to rotatably drive the shafts, these previously known automatic paint stirring equipment typically utilize a pulley secured to an upper end of each of the shafts. An elongated endless belt then extends around the pulleys and is itself rotatably driven by a motor. Consequently, as the drive pulley is rotatably driven by the motor, the pulleys, and thus the shafts associated with each pulley, are rotatably driven in a preset direction. This rotational movement of the shaft in turn is transmitted to the stirring assembly contained within the interior of the paint can to stir the paint in the desired fashion.

One disadvantage of the previously known automatic paint stirring equipment is that, because the stirring assembly within the interior of each paint can is rotatably driven in a preset rotational direction, the stirring assemblies must be driven at a relatively high rotational speed in order to ensure proper mixing or stirring of the paint. This relatively high speed rotational movement of the shafts as well as their associated components, however, creates undue wear and tear for the paint stirring equipment thus requiring relatively frequent maintenance and part replacement.

SUMMARY OF THE PRESENT INVENTION

The present invention provides a novel drive mechanism for automatic paint stirring equipment which overcomes all of the above-mentioned disadvantages of the previously known automatic paint stirring equipment.

In brief, in the conventional fashion, the paint stirring equipment of the present invention includes a housing having a plurality of shafts rotatably mounted to the housing about a generally vertical axis. The housing itself is adapted to support a plurality of paint cam each of which has a paint lid with a stirring assembly rotatably mounted to the lid and contained within the interior of the paint can.

Once the paint can is inserted into and supported by the housing, a detachable coupling between the lower end of each shaft and an upper end of the stirring assembly on the paint can positioned below the shaft engage each other so that rotational movement of the shaft is transmitted to the stirring assembly.

Unlike the previously known automatic paint stirring equipment, however, a driven member, preferably a gear wheel, is secured to the upper end of each shaft. An elongated rigid drive member, preferably a gear rack, is then longitudinally slidably mounted to the housing so that the gear rack simultaneously meshingly engages with a plurality of gear wheels secured to the shafts. Consequently, longitudinal displacement of the gear rack simultaneously rotatably drives the gear wheels with their associated shafts in a rotational direction dependent upon the direction of longitudinal movement of the gear rack.

In order to longitudinally reciprocally drive the gear rack, the present invention includes a motor which rotatably drives a wheel about an axis generally parallel with the axis of the drive shafts. An elongated link is then pivotally secured at one end to one end of the gear rack and at its other end to the drive wheel adjacent its outer periphery. Consequently, upon rotation of the drive wheel, the drive wheel via the link longitudinally reciprocally drives the gear rack. In doing so, the drive shafts, and thus the stirring assembly associated with each drive shaft, are reciprocally rotatably driven in alternating rotational directions.

In practice, the alternating rotational movement of the stirring assembly associated with the lid for each paint can produces enhanced agitation of the paint contained within the paint can and thus ensures complete mixing of the paint. Furthermore, the rotational movement of the stirring assembly in the present invention can be accomplished at a much lower rotational speed than would the previously known unidirectional rotational stirring assemblies, thereby reducing the overall wear and tear and maintenance costs of the automatic paint stirring equipment.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
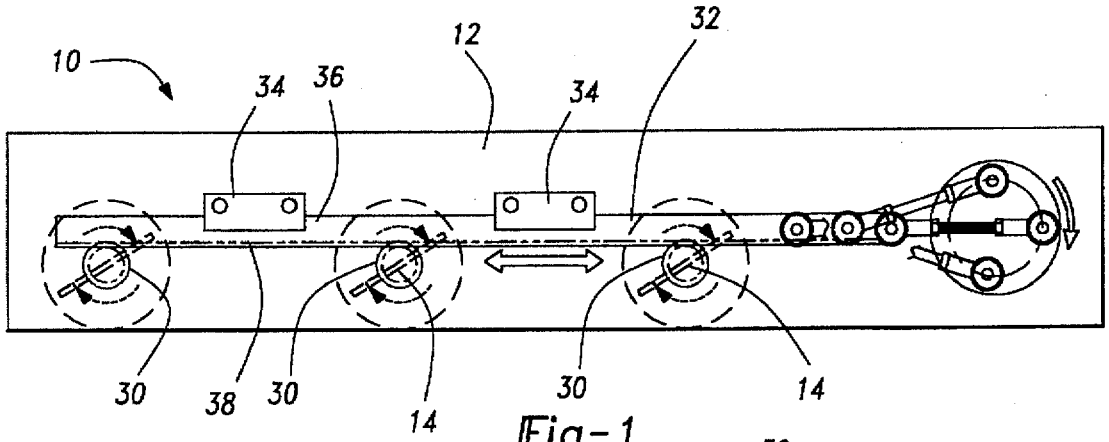
FIG. 1 is a top plan view illustrating a preferred embodiment of the present invention.
Figure 2:
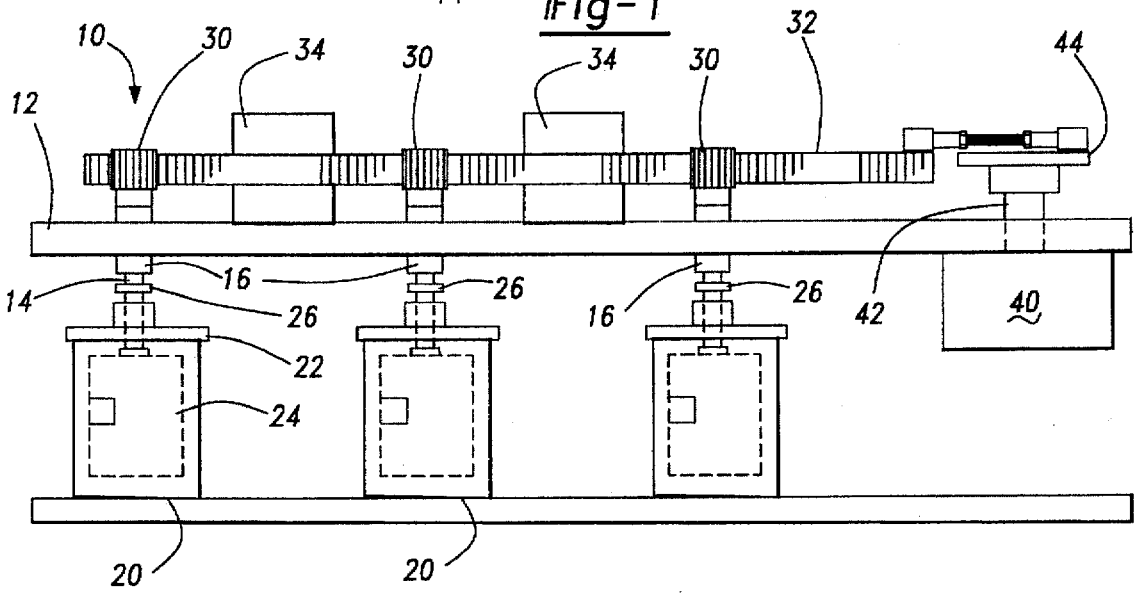
FIG. 2 is a side view illustrating the preferred embodiment of the present invention.

With reference to FIGS. 1 and 2, automatic paint stirring equipment 10 of the type utilized in automotive paint shops is there shown. The automatic paint stirring equipment 10 includes a housing 12 having a plurality of shafts 14 rotatably mounted to the housing 12 by conventional bushing assemblies 16. Each shaft 14, furthermore, is rotatable about a generally vertical axis of rotation and the shafts 14 are aligned with each other as best shown in FIG. 1. Furthermore, as used herein, the term "paint" includes paints, lacquers and other finishes applied in liquid form to a surface.

The housing 12 for the automatic paint stirring equipment 10 is adapted to removably receive and support a plurality of paint cans 20 so that one paint can 20 is optionally associated with each shaft 14. As best shown in FIG. 2, each paint can includes a lid 22, illustrated diagrammatically, with a stirring assembly 24 rotatably mounted to the lid 22. The stirring assembly 24 is contained within the interior of the paint can 20 so that rotation of the stirring assembly 24 mixes the paint contained within the paint can 20. Additionally, a conventional coupling assembly 26, illustrated diagrammatically, is operatively disposed between each shaft 14 and its associated stirring assembly 24 for its associated paint can 20. Upon insertion of the paint can 20 into the housing 12, the coupling 26 automatically couples the stirring assembly 24 to the shaft 14 so that the stirring assembly 24 rotates in unison with the rotation of the shaft 14.

In order to rotatably drive the shafts 14 and thus their associated stirring assemblies 24, a driven member or gear wheel 30 is secured to the upper end of each drive shaft 14. An elongated rigid drive member 32, preferably a gear rack, is longitudinally slidably mounted to the housing 12 by bearing blocks 34. The bearing blocks 34 slidably engage one side 36 of the drive member 32 and ensures that the opposite side 38, i.e. the two sides of the drive member 32, remains in meshing engagement with the gear wheels or driven members 30 secured to the shafts 14. Consequently, longitudinal displacement of the drive member 32 simultaneously rotatably drives the shafts 14 in a rotational direction dependent upon the longitudinal direction of movement of the drive member 32.

In the preferred embodiment of the invention, the drive member 32 comprises an elongated gear rack while the driven members 30 comprise pinions or gear wheels. Other arrangements, for example a frictional engagement between the drive member 32 and driven members 30, may alternatively be employed.

Additionally, the drive blocks 34 are preferably constructed from a synthetic polymer material such as plastic, teflon or the like having a low coefficient of friction. Use of such material insures minimal wear and tear for both the guide blocks 34 as well as the drive member 32.

Figure 3:
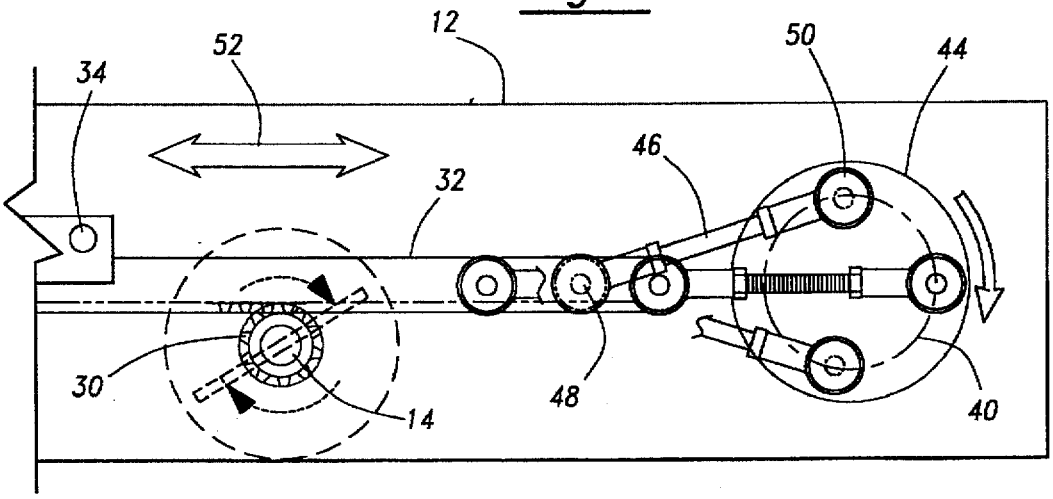
FIG. 3 is a fragmentary top view of a portion of the preferred embodiment of the present invention and enlarged for clarity.

With reference now particularly to FIG. 3, the drive member 32 is reciprocally longitudinally driven which simultaneously produces alternating rotational movement of the drive shafts 14 and their associated stirring assemblies 24. FIG. 3 illustrates a preferred embodiment of the drive member in which a motor 40 rotatably drives a shaft 42 (FIG. 2), either directly or indirectly, about an axis parallel to the axis of the shafts 14. A wheel 44 is secured to the top of the shaft 42 so that the wheel 44 rotates in unison with the shaft 42. Still referring to FIGS. 2 and 3, an elongated link 46 has one end 48 pivotally secured to one end of the drive member 32. The opposite end 50 of the link 46 is pivotally secured to the wheel 44 adjacent its outer periphery and thus at a position radially spaced from the axis of rotation of the wheel 44.

As best shown in FIG. 3, upon rotation of the wheel 44 by the motor 40, the driving connection between the link 46 and the drive member 32 longitudinally reciprocally drives the drive member 32 as indicated by arrow 52 for each complete rotation of the wheel 44. In doing so, the rotation of the shafts 14 and thus of their associated stirring assemblies 24 alternate in rotational direction for each revolution of the wheel 44.

Since the stirring assemblies 24 are alternately driven in opposite rotational directions, the stirring assemblies 24 agitate the paint or other liquid contained within the interior of the paint can 20. Furthermore, in view of the enhanced agitation caused by the alternating rotation of the stirring assemblies 24, the stirring assemblies 24 can be rotated at a much slower speed than the previously known unidirectional stirring assemblies thus minimizing wear and tear and maintenance costs for the automatic paint stirring equipment.

From the foregoing, it can be seen that the present invention provides a simple and highly effective drive mechanism for automatic paint stirring equipment. Having described my invention, however, many modifications thereto will become apparent to those skilled in the art to which it pertains without deviation from the spirit of the invention as defined by the scope of the appended claims.

I claim:

1. For use in conjunction with automatic paint stirring equipment of the type having a housing with a plurality of spaced apart and parallel shafts rotatably mounted to the housing, each shaft adapted for detachable driving connection with a stirring assembly associated with a paint can, a drive mechanism for reciprocally simultaneously driving a plurality of said shafts comprising:

a driven member secured to each of said shafts, an elongated rigid drive member, said drive member having means for drivingly engaging a plurality of said driven members so that longitudinal movement of said drive member simultaneously rotatably drives said driven members, means for longitudinally reciprocally driving said drive member wherein said longitudinal reciprocal driving means comprises:

a motor which drives an output shaft, an elongated link, means for pivotally connecting one end of said link to one end of said drive member, and means for pivotally connecting the other end of said link to said output shaft at a position radially spaced from an axis of rotation of said output shaft.

2. The invention as defined in claim 1 and comprising a wheel secured to said output shaft and wherein said other end of said link is pivotally connected to said wheel adjacent an outer periphery of said wheel.

3. The invention as defined in claim 1 wherein each driven member comprises a gear wheel and wherein said drive member comprises a gear rack which meshingly engages with said gear wheels.

4. The invention as defined in claim 1 and comprising a pair of spaced bearing blocks secured to the housing so that said bearing blocks abut against a side of the drive member opposite from the driven members.

5. The invention as defined in claim 4 wherein said bearing blocks are constructed of a material having a low friction coefficient.

6. The invention as defined in claim 5 wherein said bearing blocks are constructed of a polymer material.

* * * * *